US007152964B2

(12) United States Patent
Jeanmaire

(10) Patent No.: US 7,152,964 B2
(45) Date of Patent: Dec. 26, 2006

(54) VERY HIGH SPEED PRINTING USING SELECTIVE DEFLECTION DROPLET SEPARATION

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 306 days.

(21) Appl. No.: 10/817,384

(22) Filed: Apr. 2, 2004

(65) Prior Publication Data

US 2004/0233243 A1 Nov. 25, 2004

Related U.S. Application Data

(63) Continuation-in-part of application No. 10/442,918, filed on May 21, 2003, now abandoned.

(51) Int. Cl.
*B41J 2/07* (2006.01)
*B41J 2/205* (2006.01)

(52) U.S. Cl. ..... 347/74; 347/15

(58) Field of Classification Search ..... 347/10, 347/15, 74, 75, 77, 78, 82, 83
See application file for complete search history.

(56) References Cited

U.S. PATENT DOCUMENTS 3,709,432 A 1/1973 Robertson
4,350,986 A 9/1982 Yamada
4,930,018 A * 5/1990 Chan et al. ..... 358/534
5,087,981 A * 2/1992 Ng et al. ..... 358/3.05
5,140,432 A * 8/1992 Chan ..... 358/3.03
5,224,843 A 7/1993 van Lintel
5,374,997 A * 12/1994 Eschbach ..... 358/466
6,068,361 A * 5/2000 Mantell ..... 347/15
6,089,691 A * 7/2000 Kakutani ..... 347/15
6,257,686 B1 7/2001 Takahashi et al.
6,450,628 B1 9/2002 Jeanmaire et al.
6,464,336 B1 10/2002 Sharma
6,505,921 B1 1/2003 Chwalek et al.

* cited by examiner

*Primary Examiner*—An H. Do
(74) *Attorney, Agent, or Firm*—Mark G. Bocchetti; Milton S. Sales

(57) ABSTRACT

A method for ink jet printing a plurality of pixels corresponding to a digital image including pixels of image data is taught using a half toning algorithm wherein droplets of two different volumes are formed. The method includes the steps of determining if the print command is invalid by examining previously formed adjacent print commands; replacing an invalid print command with a valid print command resulting in a modified error value to be diffused; and diffusing the modified error value in accordance the half toning algorithm.

12 Claims, 6 Drawing Sheets

| | |
|---|---|
| FIG. 5A | |
| FIG. 5B | |

VERY HIGH SPEED PRINTING USING SELECTIVE DEFLECTION DROPLET SEPARATION

CROSS-REFERENCE TO RELATED APPLICATION

This is a continuation-in-part of application Ser. No. 10/442,918, filed May 21, 2003, now abandoned, entitled Very High Speed Printing Using Selective Deflection Droplet Separation, by David L. Jeanmaire.

FIELD OF THE INVENTION

This invention relates generally to the field of digitally controlled printing devices, and in particular to continuous printers, such as ink jet printers, wherein a liquid stream breaks into droplets, some of which are selectively deflected.

BACKGROUND OF THE INVENTION

Traditionally, digitally controlled color printing capability is accomplished by one of two technologies. Liquid, such as ink, is fed through channels formed in a print head. Each channel includes a nozzle from which droplets are selectively extruded and deposited upon a medium.

The first technology, commonly referred to as "droplet on demand" printing, provides droplets for impact upon a recording surface. Selective activation of an actuator causes the formation and ejection of a flying droplet that strikes the print media. The formation of printed images is achieved by controlling the individual formation of droplets. For example, in a bubble jet printer, liquid in a channel of a print head is heated creating a bubble that increases internal pressure to eject a droplet out of a nozzle of the print head. Piezoelectric actuators, such as that disclosed in U.S. Pat. No. 5,224,843, issued to VanLintel, on Jul. 6, 1993, have a piezoelectric crystal in a fluid channel that flexes when an electric current flows through it forcing a droplet out of a nozzle.

The second technology commonly referred to as "continuous stream" or "continuous" printing, uses a pressurized liquid source which produces a continuous stream of droplets. Conventional continuous printers utilize electrostatic charging devices that are placed close to the point where a filament of working fluid breaks into individual droplets. The droplets are electrically charged and then directed to an appropriate location by deflection electrodes having a large potential difference. When no print is desired, the droplets are deflected into a liquid capturing mechanism commonly referred to as a catcher, an interceptor, a gutter, etc. and either recycled or disposed of. When print is desired, the droplets are not deflected and allowed to strike a print media. Alternatively, deflected droplets may be allowed to strike the print media, while non-deflected droplets are collected in the capturing mechanism.

As conventional continuous printers utilize electrostatic charging devices and deflector plates, they require many components and large spatial volumes in which to operate. This results in continuous print heads and printers that are complicated, have high energy requirements, are difficult to manufacture, and are difficult to control.

U.S. Pat. No. 3,709,432, issued to Robertson, on Jan. 9, 1973, discloses a method and apparatus for stimulating a filament of working fluid causing the working fluid to break up into uniformly spaced droplets through the use of transducers. The lengths of the filaments before they break up into droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the droplets themselves. By controlling the lengths of the filaments, the trajectories of the droplets can be controlled, or switched from one path to another. As such, some droplets may be directed into a catcher while allowing other droplets to be applied to a receiving member.

Commonly assigned U.S. Pat. No. 6,554,410 issued in the name David L. Jeanmaire et al. on Apr. 29, 2003, discloses so-called "stream" continuous-jet printing wherein nozzle heaters are selectively actuated at a plurality of frequencies to create the stream of droplets having the plurality of volumes. A force is applied to the droplets at an angle to the stream to separate the droplets into printing and non-printing paths according to drop volume. The force is applied by a flow of gas. This process consumes little power, and is suitable for printing with a wide range of inks.

Stream printing can be implemented in either of two complementary modes. The first is the so-called "small-drop" mode in which small droplets are directed to the image receiver and larger drops are captured by a gutter. In the second, "large-drop" mode, small droplets are guttered, while larger drops impact upon the image receiver. While high throughput and small drop size are desired characteristics of a printing system, these characteristics tend to be mutually exclusive in prior art "small-drop" or "large-drop" printers. Small-drop mode printers print with the smallest possible drop size, but cannot normally reach 100% of liquid utilization. Typically, a system running in small-drop mode has a liquid utilization factor less than 50%. On the other hand, in large-drop mode, liquid utilization can reach 100% at the expense of a larger size printing droplets, at least twice the size of the small-drop mode printers.

SUMMARY OF THE INVENTION

It is an object of the present invention to provide for the printing in the small-drop mode with enhanced liquid utilization. Optimally, the invention allows liquid utilization to reach 100%, thereby more than tripling throughput and reaching high printing pixel rates According to a feature of the present invention, a plurality of pixels of image data are produced by causing a stream of droplets to form with droplets of a first volume being formed over a first time period associated with printing a pixel of image data; and droplets of a second volume being formed over a second time period which is at least twice as long as the first time period.

The present invention is a method for printing a plurality of pixels corresponding to a digital image comprising pixels of image data. The method comprises the steps of producing a stream of droplets including printing droplets having a first volume each selectively formed over a first time period and non-printing droplets having a second volume each selectively formed over a second time period, the second volume being a multiple of the first volume, the multiple being a volume discrimination ratio between printing droplets and non-printing droplets; forming a print command using a half toning algorithm for printing a pixel in a two-dimensional array, the pixel having a print value; determining if the print command is invalid by examining previously formed adjacent print commands; replacing an invalid print command with a valid print command resulting in a modified error value to be diffused; and diffusing the modified error value in accordance the half toning algorithm.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
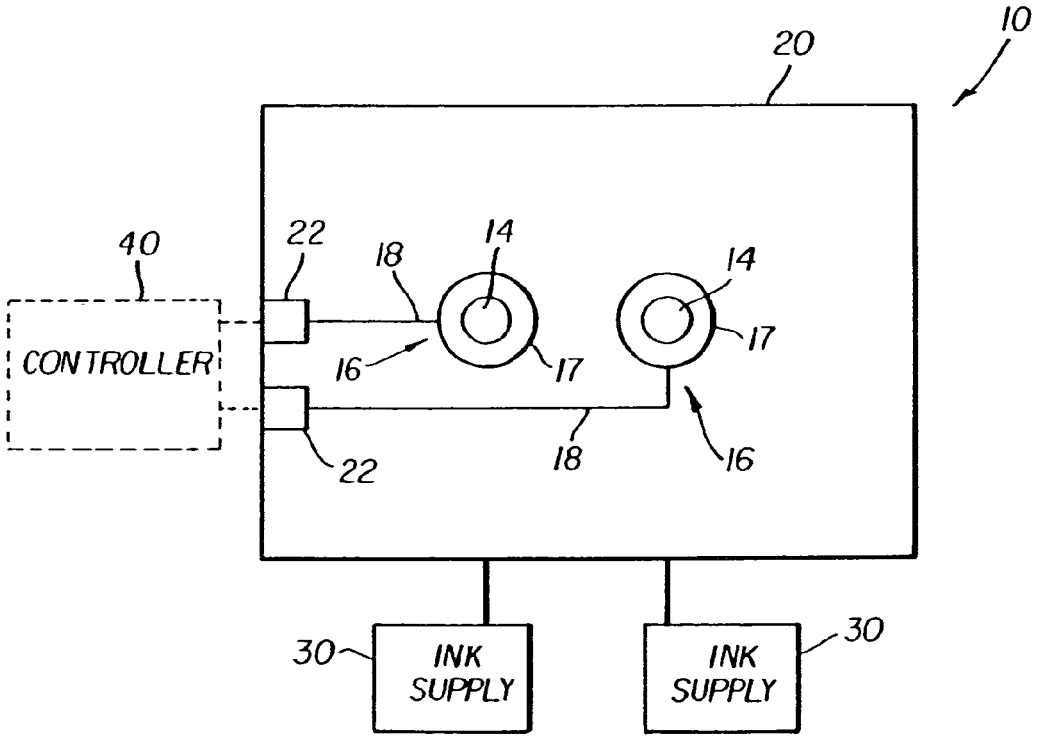
FIG. 1 is a schematic view of a print head.

Referring to FIG. 1, a droplet forming mechanism 10 of a preferred embodiment of the present invention is shown. Although mechanism 10 is illustrated schematically and not to scale for the sake of clarity, one of ordinary skill in the art will be able to readily determine the specific size and interconnections of the elements of the preferred. Mechanism 10 includes a print head 20, one or more nozzles 14, at least one liquid supply 30, and a controller 40. Print head 20 may incorporate additional liquid supplies 30 and nozzles 14 in order to provide high speed color printing using three or more colors. Nozzles 14 are in fluid communication with liquid supplies 30 through a passage (not shown) also formed in print head 20. Each liquid supply 30 may contain a different color for color printing. Black and white or single color printing may be accomplished using a single liquid supply 30.

Print head 20 may be formed from a semiconductor material (silicon, etc.) using known semiconductor fabrication techniques (CMOS circuit fabrication techniques, micro electro mechanical structure (MEMS) fabrication techniques, etc.). However, print head 20 may be formed from any materials using any fabrication techniques conventionally known in the art. There can be any number of nozzles 14 and the separation between nozzles 14 can be adjusted in accordance with the particular application to avoid smearing and deliver the desired resolution.

Print head 20 can be of any size and components thereof can have various relative dimensions. Heater 16, pad 22, and conductor 18 can be formed and patterned through vapor deposition and lithography techniques, etc. Heater 16 can include heating elements of any shape and type, such as resistive heaters, radiation heaters, convection heaters, chemical reaction heaters (endothermic or exothermic), etc. The invention can be controlled in any appropriate manner. As such, controller 40 can be of any type, including a microprocessor based device having a predetermined program, etc.

A heater 16 is positioned on print head 20 at least partially around each nozzle 14. Although heaters 16 may be disposed radially away from the edge of the nozzle bore, the heater is preferably disposed close to the edge of the bore in a concentric manner. In a preferred embodiment, heaters 16 are formed in a substantially circular or ring shape. However, it is contemplated that the heaters may be formed in a partial ring, square, etc. Heaters 16 include an electric resistive heating element 17 electrically connected to pads 22 via conductors 18.

Figure 2:
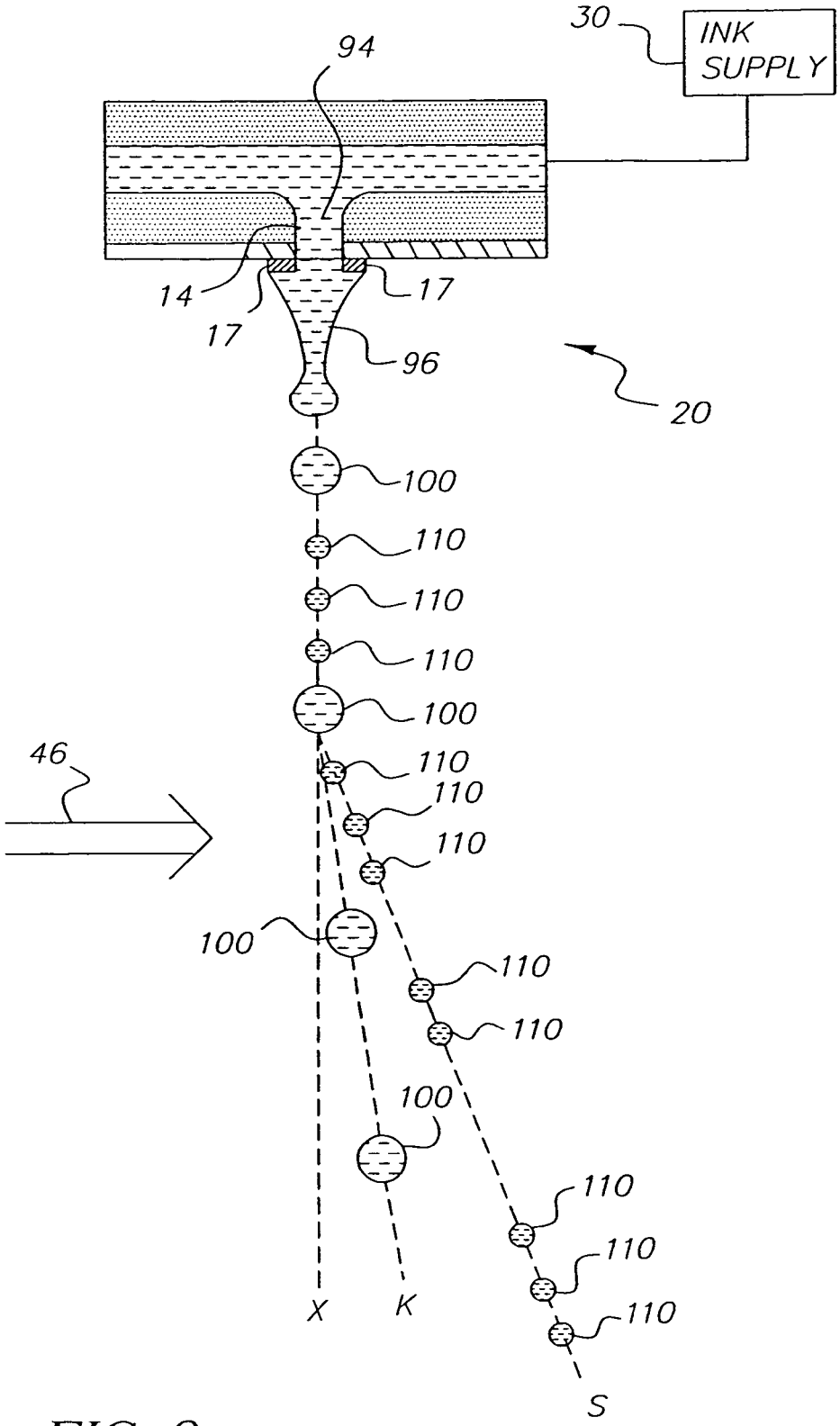
FIG. 2 is a schematic view of operation of a printer having the print head of FIG. 1.
Figure 3A:
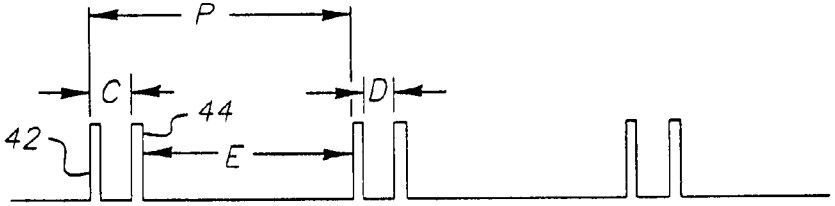
FIGS. 3(*a*)–3(*d*) are illustrations of operation of the printer of FIG. 2 according to convention.
Figure 3B:
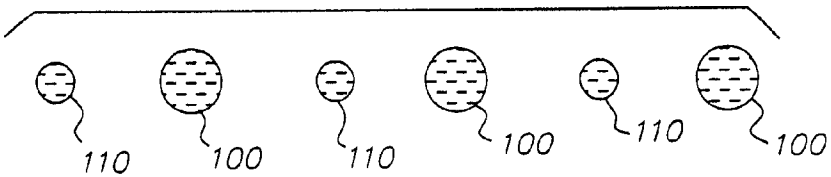
Figure 3C:
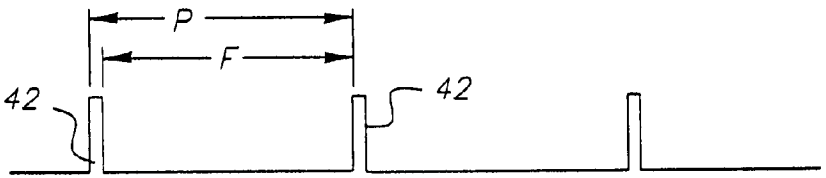
Figure 3D:
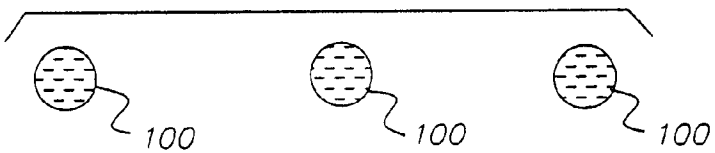
Figure 4A:
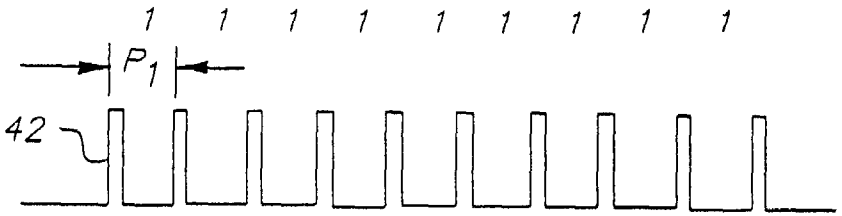
FIGS. 4(*a*)–4(*d*) are illustrations of operation of the printer of FIG. 2 according to the present invention.
Figure 4B:
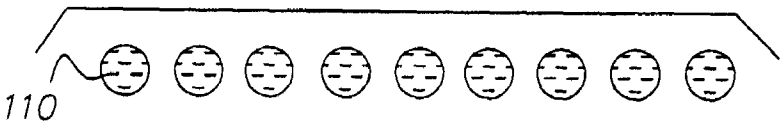
Figure 4C:
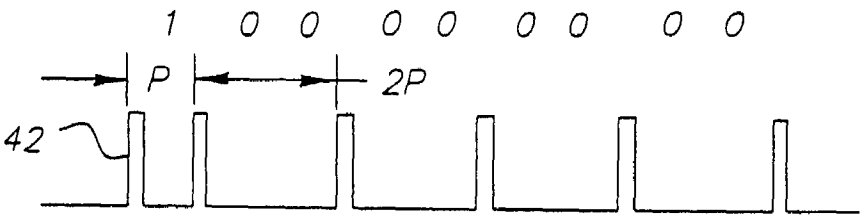
Figure 4D:
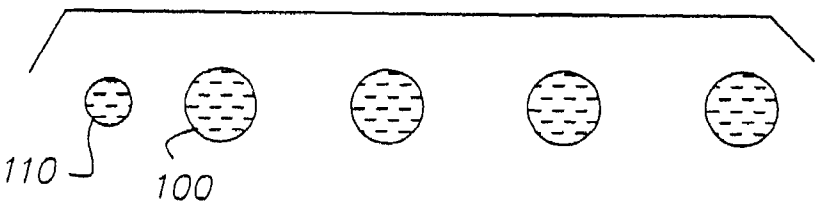

Referring to FIG. 2, pressurized liquid 94 from supply 30 is ejected through nozzle 14 of print head 20 creating a filament 96 of ink. Resistive heating element 17 is selectively activated at various frequencies causing filament 96 to break up into a stream of individual droplets 100 and 110 with each droplet having a predetermined volume. The volume of each droplet depends on the frequency of activation of heater 16. A high frequency of activation of heater 16 results in small volume droplets 110; and a low frequency of activation of heater 16 results in large volume droplets 100.

Large volume droplets 100 and small volume droplets 110 are ejected from droplet forming mechanism 10 substantially along ejection path X in a stream. A droplet deflector system applies a force (shown generally at 46) to droplets 100 and 110 as the droplets travel along path X. Droplet deflector system can include a gas source that provides force 46. Typically, the force is directed at an angle with respect to the stream of droplets operable to selectively deflect droplets an amount inverse to droplet volume.

Force 46 interacts with droplets 100 and 110, causing the droplets to alter course. Because droplets 100 and 110 have different volumes and masses, force 46 causes large droplets 100 to diverge from path X along a deflection path K to a catcher (not shown). Small droplets 110 are more affected by force 46, diverge from path X along a deflection path S.

In order to best describe the current invention, we first consider the printing system of above-mentioned U.S. Pat. No. 6,554,410. Referring to FIGS. 3(*a*) to 3(*d*) of the present application, there are only two states to consider: a printing condition and a non-printing condition. FIG. 3(*a*) is a schematic of the waveform used for heater activation for the printing condition wherein one printing drop 110 is produced per pixel. Such a waveform could be described by digital data encoding information as to whether large or small drops were to be provided or, equivalently, whether heater pulses were or were not to be provided at regular time intervals, as is well known in the art of digital imaging. Digital data could be derived, for example, from scanning a continuous tone photographic image and processing the continuous tone data by a half-toning algorithm.

A predetermined amount of liquid is ejected from the nozzle during an allocated constant time "P" for each image pixel, regardless of the image data to be recorded. As a consequence, a large, non-printing drop 100, shown in FIG. 3(*b*), must be created for every image pixel, although the volume of the large drop changes with the number of printed drops 110 per pixel. For example, in printing a pixel with one printing droplet, an initial volume of small drop 110 is directed to the image receiver, and the remainder of the liquid flow during the pixel time P is formed into large drop 100 to be guttered. For the non-printing state "ZERO" shown in FIGS. 3(*c*) and 3(*d*), the volume of non-printing drop 100 is equal to the liquid flow per pixel, and the non-printing drop is larger in this state. When multiple printing droplets are applied in a single pixel, non-printing drop 100 decreases in size accordingly but is still a non-printing drop As an example of the printing system of above-mentioned U.S. Pat. No. 6,554,410, assume that the fastest that heating elements 17 can be pulsed, while still obtaining stable drop formation, is 500 kHz (or a period "C" of 2 μs). This determines the appropriate time interval for creating a small printing drop. For the purpose of discriminating between small and large drops, we assume that the minimum acceptable volume ratio or discrimination ratio of large to small drops is 2. In practice, other discrimination ratios are useful as well, particularly discrimination ratios in the range of from 2 to 10. Thus, at least a 4 μS period is required for forming the large drops 100. Referring again to FIGS. 3(*a*) and 3(*b*), we assume a waveform that creates one small drop 110 followed by one large drop 100. Heater pulses 42 and 44 are 0.5 μs in duration, so delay "D" is 1.5 μs and delay "E" is 3.5 μs. The total time "P" for printing an image pixel is therefore 6 μs. Since the non-printing state must have the same pixel time, the waveform for the non-printing state shown in FIGS. 3(*c*) and 3(*d*) has a pulse duration of 0.5 μs and a delay "F" of 5.5 μs. In summary, the timing as depicted in the traces of FIGS. 3(*a*) and 3(*c*) for the printing system of above-mentioned U.S. patent application Ser. No. 09/750,946 yields a liquid utilization factor of 33%, based on the ratio C to D as described in U.S. Pat. No. 6,554,410.

Referring to FIGS. 4(*a*) and 4(*b*), and according to a feature of the present invention, pixel time "$P_1$" is set equal to the electrical period time "C" for small drop formation as diagrammed in FIG. 3(*a*). A small drop 110 is created in the 2 μs time of pulse 42 and delay "D". As many small drops in a row can be printed as desired, shown schematically in FIG. 4(*b*), if all pixel times P1 contain a pulse 42. For example, image data for printing three small drops in a row could be denoted by the sequence (1,1,1) corresponding to the desired number (one) of printing drops to be placed on each of three consecutive pixels on the recording media during a time interval of duration 3 times P1.

Consider now the case in which a non-printing drop is formed immediately after a printing drop has been formed, as shown for the waveform of FIG. 4(*c*). We consider only the case of a single nozzle printing consecutive pixels P1 in a line on a recording medium. It is understood that other nozzles, typically located in a row of nozzles, print consecutive pixels P1 along other lines on a recording medium to form a complete image as the head is scanned in a fast scan direction, typically perpendicular to the row of nozzles. It is also understood, but is not the topic addressed by the present invention, that the scans in the fast scan direction may be repeated to enhance image quality, as is well known in the art of inkjet printing. A non-printing drop 100 takes up two pixel intervals in the example case discussed here for which the discrimination ratio is 2; thus the volume of the non-printing drop is equivalent to the volume of two printing drops, the time required to produce the non-printing drop is twice that for the printing drop (2 times P1), and the image printed on the recording medium for the waveform of FIG. 4(*c*) corresponds to three pixels printed over a time period of 3 times P1. The first pixel contains a printing drop and the last two pixels contain no drops. (In general, for a discrimination ratio of n, a non-printing drop takes up n pixel intervals, as taught in U.S. Pat. No. 6,554,410; and, for the general case, n would replace 2 in discussion above.) Assuming the image data desired to be printed on the recording medium calls for a printing drop in one pixel of the recording media followed by no drops printed in the next two consecutive pixels, than the desired image is printed by the waveform of FIG. 4(*c*) which produces the drop sequence described above. Such desired image data could be represented by the sequence (1,0,0) corresponding to the desired number of printing drops to be placed on three consecutive pixels on the recording media during a time interval of duration 3 times P1. In this case, the desired image is correctly printed. However, a problem arises, for printing systems operating in accordance with that disclosed in U.S. Pat. No. 6,554,410, if the desired image to be printed is (1,0,1) since a large drop is required to prevent printing on the recording media and since two time intervals P1 are required to produce a large drop. (n time intervals are required for the general case in which the discrimination ratio is n.) That is to say, the sequence (1,0,1) in not available to be printed, or in other words, the sequence (1,0,1) is invalid, since no sequence of pulses of the type shown in FIG. 4*c* can produce the desired printed pixels. In accordance with the present invention, such an invalid sequence is to be replaced by a related valid sequence, for example the valid sequence (1,0,0) or the valid sequence (1,1,1), corresponding to FIGS. 4*c* and 4*a* respectively. The method of replacement incorporates a modified half toning algorithm.

The motivation for such an algorithm can be seen from the observation that if all invalid sequences (1,0,1) were simply replaced with the sequence (1,0,0), resulting in an error in the form of a loss of one printing drop for each such replacement, the resulting image would show objectionable contouring artifacts, as is well known in the art of image processing. A well-know solution to contour artifacts uses a half toning algorithm to diffuse the contouring errors spatially. This error diffusion minimizes the visual impact of contouring by trading spatial accuracy of printed drops for accuracy in rendering the correct optical density averaged over many pixels of the printed image, as is well known in the half toning art. In accordance with the present invention, image data in the form of a continuous tone image is processed by one or more standard half toning algorithms, for example a Floyd-Steinberg algorithm, modified to produce binary sequences for the binary printing of drops in pixels on a recording media in which the replacement of all invalid sequence is integrated into the half toning algorithm by supplementing the rules for error diffusion with rules that allow only valid sequences. In other words, the error diffusion rules are changed to ensure only valid sequences are sent to the printing system. This is accomplished by including the error incurred by replacing an invalid sequence by a valid sequence with the error accumulation function of the algorithm, as is easily appreciated by one skilled in image processing, and is illustrated by the following explicit example of a linear error diffusion algorithm. In this example, the image data input of the first line is assumed to be continuous tone data in the range of from 0 to 256 (so-called 8 bit) corresponding to the desired minimum to maximum range of optical density printed in each pixel. Shown on the second line, the unmodified half-toning algorithm output produces binary data (0 or 1) corresponding to the whether or not a drop should printed in each pixel, so as to approximate the continuous tone image. In this example, the half tone algorithm assume that a drop is to be printed if the continuous tone value, including the error diffused, equals or exceeds a transition value equal to 128 and that no drop is to be printed if the continuous tone value, including the error diffused, is less than the transition value. The algorithm diffuses the entire error for any pixel forward (left to right) to the next adjacent bit. The modified algorithm shown on the third line outputs binary data (0 or 1) corresponding to the whether or not a drop should printed in each pixel consistent with the allowed sequences of pulses for the print technology described in –796. In this modification, if the sequence ( . . . 0.1,0,1 . . . ) occurs, the algorithm, disallows the third 1 by requiring the transition value to be 1. Otherwise, the algorithm is unmodified.

EXAMPLE I

Image Data Input: (130, 88, 250, 200, 10, 10, 250, 250, 250, 198 . . . )

Halftone Algorithm Output: (1,0,1,1,0,0,1,1,1,0 . . . )

Modified Halftone Algorithm: (1,0,0,1,1,0,0,1,1,1 . . . )

The algorithm in the example is effective because the human visual system has a limited spatial frequency response. Thus, and especially for small drop sizes in the image, the eye blends fine detail and records overall intensity. The technique of error diffusion is a commonly used dithering or half toning method. Error diffusion is a neighborhood process, which specifically deals with errors in converting continuous to binary data. It is a simple matter to incorporate the error in printing double zeros as described above into the other errors processed by the error diffusion algorithm.

The visual impact of the type of printing errors described above is minimized by the half-toning algorithm by trading spatial accuracy for accuracy in rendering the correct optical density in the printed image. Printing requires the use of a half-toning algorithm to convert continuous-tone pictorial images into drop patterns on the image receiver because the human visual system has a limited spatial frequency response. Thus, and especially for small drop sizes in the image, the eye blends fine detail and records overall intensity. The technique of error diffusion is a commonly used dithering or half toning method. Error diffusion is a neighborhood process which specifically deals with errors in converting continuous to binary data.

Figure 5A:
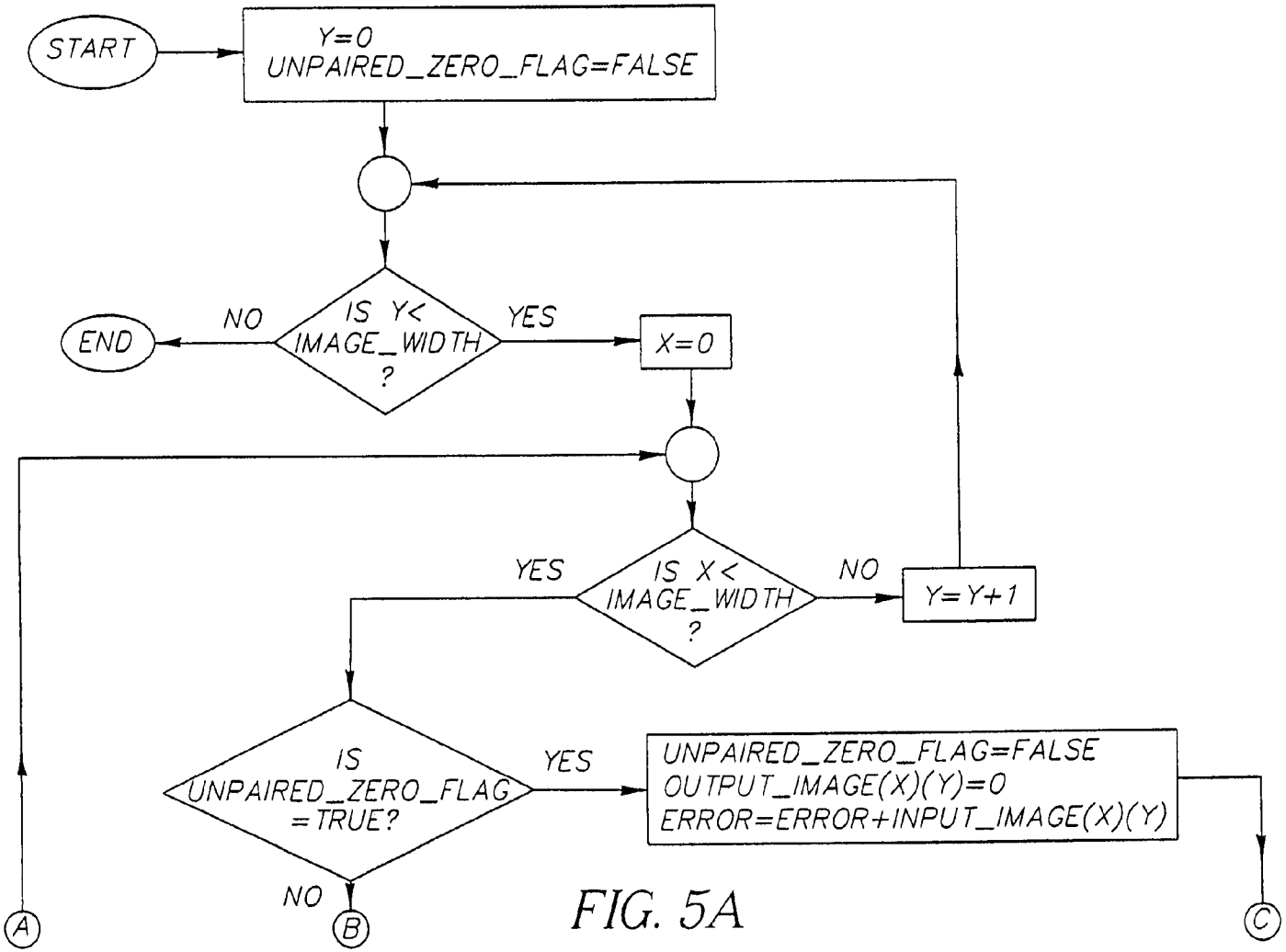
FIGS. 5(A)–5(B) are a flow diagram of an error diffusion technique.
Figures 5, 5B:
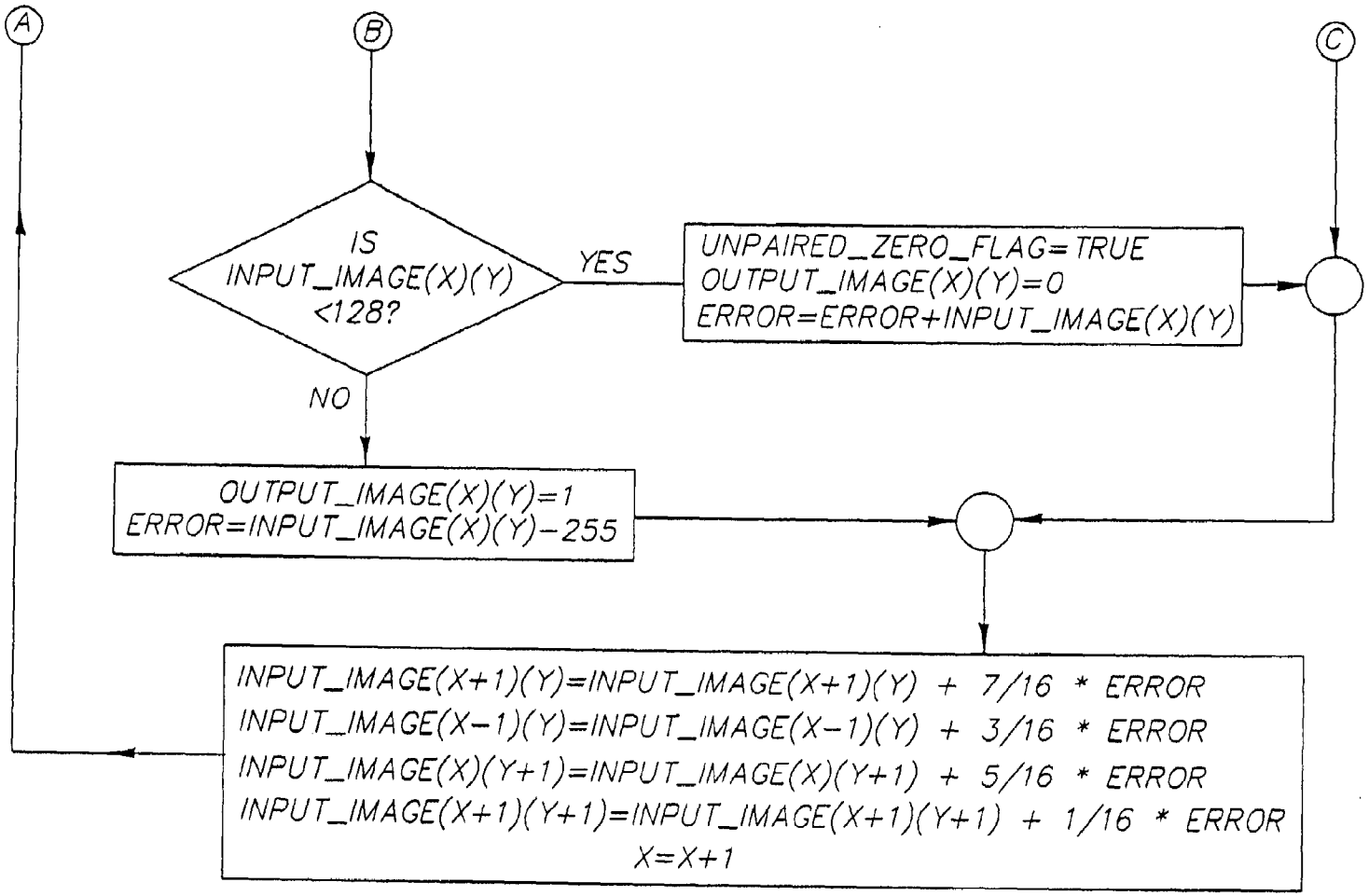

It is a simple matter to incorporate the error in printing double zeros as described above into the other t algorithms, such as the two dimensional error diffusion algorithm of Example II. Example II is a two-dimensional pseudocode for modified error diffusion, according to a Floyd Steinberg filter with input data scaled from 0 to 255 and a single output level. The flow chart of FIGS. 5(A)–5(B) illustrate the following pseudocode:

```
FOR Y=0 TO IMAGE_HEIGHT
    FOR X=0 TO IMAGE_WIDTH
        IF UNPAIRED_ZERO_FLAG = FALSE
            UNPAIRED_ZERO_FLAG = 1
            OUTPUT_IMAGE[X][Y] = 0
            ERROR = ERROR + INPUT_IMAGE[X][Y]
        ELSE
            IF INPUT_IMAGE[X][Y] < 128
                UNPAIRED_ZERO_FLAG = TRUE
                OUTPUT_IMAGE[X][Y] = 0
            ELSE
                OUTPUT_IMAGE[X][Y] = 1
                ERROR = INPUT_IMAGE - 255
        INPUT_IMAGE[X + 1][Y] = INPUT_IMAGE[X + 1][Y] + 7/16 *
        ERROR
        INPUT_IMAGE[X - 1][Y] = INPUT_IMAGE[X - 1][Y] + 3/16 *
        ERROR
        INPUT_IMAGE[X][Y + 1] = INPUT_IMAGE[X][Y + 1] + 5/16 *
        ERROR
        INPUT_IMAGE[X + 1][Y + 1] = INPUT_IMAGE[X + 1][Y + 1]
        + 1/16 * ERROR
```

In calculating OUTPUT_IMAGE(X+1,Y), the unpaired zero flag is set (to 1) whenever OUTPUT_IMAGE (X−1), OUTPUT_IMAGE(X,Y) AND OUTPUT_IMAGE (X+1,Y) calculated by the algorithm equals the sequence (101). If the flag is set, the algorithm alters the calculation to require INPUT_IMAGE (X+1,Y) be below the threshold for printing a drop so that the sequence OUTPUT_IMAGE (X−1), OUTPUT_IMAGE(X,Y) AND OUTPUT_IMAGE (X+1,Y) is recalculated to be the sequence (100), the resulting new value of the error being diffused in accordance with the unmodified algorithm. This is an example of a simplest case, in that error diffusion algorithms have many refinements and extensions. For example, it is common to add noise to the dither threshold and to use a serpentine raster to break up "worm" artifacts.

The condition given here, where the time for one non-printing drop equals two printing drops was chosen for the purpose of example only, and the method can be extended to other cases where the heater activation times for creating a non-printing drop are an integer multiple of the times for creating a printing drop.

| PARTS LIST | |
|---|---|
| 10 | mechanism |
| 14 | nozzles |
| 16 | heater |
| 17 | element |
| 18 | conductor |
| 20 | print head |
| 22 | pad |
| 30 | liquid supply |
| 40 | controller |
| 42 | heater pulses |
| 44 | heater pulses |
| 46 | force |
| 94 | pressurized liquid |
| 96 | filament |
| 100 | large drop |
| 110 | small drop |

The invention claimed is:

1. A method for printing a plurality of pixels corresponding to a digital image comprising pixels of image data, the method comprising the steps of:

(a) producing a stream of droplets including printing droplets having a first volume each selectively formed over a first time period and non-printing droplets having a second volume each selectively formed over a second time period, the second volume being a multiple of the first volume, the multiple being a volume discrimination ratio between printing droplets and non-printing droplets;

(b) forming a print command using a half toning algorithm for printing a pixel in a two-dimensional array, the pixel having a print value;

(c) determining if the print command is invalid by examining previously formed adjacent print commands;

(d) replacing an invalid print command with a valid print command resulting in a modified error value to be diffused; and (e) diffusing the modified error value in accordance with the half toning algorithm.

2. A method for printing as recited in claim 1 wherein: the diffusing step is performed one-dimensionally.

3. A method for printing as recited in claim 1 wherein: the diffusing step is performed two-dimensionally.

4. A method for printing as recited in claim 1 wherein: the half toning algorithm is an error diffusion algorithm.

5. A method for printing as recited in claim 4 wherein: the error diffusion algorithm uses input data that is scaled from 0 to 255 and produces binary output data.

6. A method for printing as recited in claim 1 wherein: an invalid print command for a selected nozzle is one in which the binary print sequence is 1, 0, 1.

7. A method for printing as recited in claim 1 wherein: an invalid print command for a selected nozzle is one in which the binary print sequence is a 1 followed by a number n of 0s followed by another 1 wherein n is less than the volume discrimination ratio.

8. A method for printing as recited in claim 1 wherein:

substantially a same number of droplets are printed in a contiguous area of pixels of the digital image as would have been printed if an original sequence of pixels of image data that includes invalid print commands could have been executed.

9. A method for printing as recited in claim 1 further comprising the step of:

repeating steps (a) through (e) for each of the plurality of pixels corresponding to the digital image.

10. A method of printing as recited in claim 1 further comprising the steps of:

(a) flowing a gas at an angle with respect to the stream of droplets;

(b) separating the droplets of the first volume from the droplets of the second volume;

(c) collecting the droplets of the second volume; and (d) allowing the droplets of the first volume to contact a print media.

11. A method of printing as recited in claim 1 wherein:

the step of producing the stream of droplets includes selectively actuating a heater at a plurality of frequencies.

12. A method of printing as recited in claim 1 further comprising the step of:

recycling the droplets of the second volume for subsequent re-use.

* * * * *